US005765942A

United States Patent [19]

Shirai et al.

[11] Patent Number: 5,765,942

[45] Date of Patent: Jun. 16, 1998

[54] OUTER LENS ATTACHMENT STRUCTURE FOR VEHICULAR LAMPS

[75] Inventors: Katutada Shirai; Takashi Matsunaga; Hironori Tsukamoto, all of Shizuoka, Japan

[73] Assignee: Koito Manufacturing Co., Ltd., Tokyo, Japan

[21] Appl. No.: 659,238

[22] Filed: Jun. 5, 1996

[30] Foreign Application Priority Data

Jun. 21, 1995 [JP] Japan ..... 7-178257
Mar. 7, 1996 [JP] Japan ..... 8-049794

[51] Int. Cl.[6] ..... F21V 21/00

[52] U.S. Cl. ..... 362/267; 362/374; 362/455

[58] Field of Search ..... 362/61, 267, 311, 362/374, 375, 455, 457

[56] References Cited

U.S. PATENT DOCUMENTS 5,180,219 1/1993 Geddie ..... 362/61

FOREIGN PATENT DOCUMENTS 1214780 4/1966 Germany ..... 362/374
2050985 4/1972 Germany ..... 362/374

*Primary Examiner*—Y My Quach
*Attorney, Agent, or Firm*—Koda & Androlia

[57] ABSTRACT

An outer lens attachment structure in which a lamp body is integrally formed with an engagement device having an engagement piece member which is bent inwardly of an opening part of the lamp body to be engaged therewith, and when the engagement piece member is depressed to be bent inwardly, the engagement piece member urges the peripheral part of the outer lens against the opening periphery of the lamp body so that the peripheral part of the outer lens is securely held between the engagement piece member and the opening periphery of the lamp body.

5 Claims, 9 Drawing Sheets

OUTER LENS ATTACHMENT STRUCTURE FOR VEHICULAR LAMPS

BACKGROUND OF THE INVENTION

1. Field of the Invention

The present invention relates generally to a vehicular lamp in which an outer lens separate provided is attached to a lamp body and, more particularly, to a vehicular lamp capable of simplifying the workability of the outer lens attachment operation.

2. Related Art

Generally, a vehicular lamp is provided with a vessel like lamp body, a reflector and a lamp bulb both installed in the lamp body, and an outer lens attached to a front opening of the lamp body. FIGS. 9A and 9B are perspective and sectional views, respectively, showing a conventional vehicular lamp of this type. As shown in the figures, a lamp body 1 is formed with a seal groove 1*a* at a front opening thereof. An outer lens 12, which is attached to the front opening of the lamp body 1, is provided at a periphery thereof with a seal leg 12*a*. A seal material 13 such as adhesive or the like is filled in the seal groove 1*a*, and the seal leg 12*a* is coupled to the seal groove 1*a* so that the sealability between the lamp body 1 and the outer lens 12 is accomplished. Further, since it is difficult to achieve a sufficient mechanical strength only by the seal material, plate springs 30 are generally employed for securely coupling the lamp body 1 to the outer lens 12, at a plural positions along the periphery of the lamp body and the outer lens. Owing to the resilient force of the plate springs 30, the opening periphery of the lamp body 1 and the peripheral part of the outer lens 12 are mechanically tighten to each other.

The plate spring 30 is formed of a metal plate material having resiliency by bending processing. As shown in FIGS. 9A and 9B, the plate spring 30 is essentially curved to have C-shape, and both edge parts of which are bent to be cylindrical, so that the edge parts perform as first and second engagement parts 31*a*, 31*b*. During the assembly process, an operator manually engages the first engagement part 31*a* with a back projecting part 1*d* of the lamp body 1 extending opposite the seal groove 1*a*, and then the operator cramps the second engagement part 31*b* to a peripheral surface 12*b* of the outer lens 12 so that the lamp body 1 and the outer lens 12 are tighten to each other by the resilient force of the plate spring 30.

During assembly, when an operator cramps the second engagement part 31*b* after the first engagement part 31*a* is engaged, the operator must expand once the plate spring 30. However, because the plate spring 30 as described above has a strong resilient force to enhance the cramping force, the cramping operation requires the operator to apply a strong pulling force. Therefore, there has been difficulty in the workability for fastening the plate spring. In addition, generally two to four plate springs are employed for a single lamp and, accordingly, the workability for assembling single lamp including a step for fastening the plate springs becomes worse if the number of components increases.

Further, the plate spring must have a high resiliency and need to be formed of a metal material having a good anti-fatigue property. Such material requires specific machining processing. As a result, the cost for producing the plate spring is high which rises up the manufacturing cost of the lamp.

SUMMARY OF THE INVENTION

The present invention was made in view of the foregoing difficulties and problems accompanying the conventional outer lens attachment structure for vehicular lamps. Therefore, an object of the invention is to provided an outer lens attachment structure for a vehicular lamp capable of stably attaching the outer lens to a lamp body without using plate spring.

According to the present invention, a lamp body is integrally formed with an engagement device having an engagement piece member which is bent inwardly of an opening part of the lamp body to be engaged therewith. When the engagement piece member is depressed to be bent inwardly, the engagement piece member urges the peripheral part of the outer lens against the opening periphery of the lamp body so that the peripheral part of the outer lens is securely held between the engagement piece member and the opening periphery of the lamp body.

Owing to the structure of the engagement device of the present invention, the outer lens can be stably attached to the lamp body without necessitating the conventional plate spring which has been provided separately from the lamp body or the outer lens. Hence, the process for cramping the plate spring can be eliminated. Accordingly, the low manufacturing cost and the easy assembly of the lamp can be realized.

Further, according to the present invention, urging projections may preferably be formed by partly expanding the thickness of the engagement piece member which contacts to a peripheral surface of the outer lens, so that the contact area with respect to the lens peripheral surface is enlarged compared to the case where there is no urging projections. Because the contact area of the engagement piece member to the peripheral surface is enlarged, the seal leg can be effectively prevented from detaching from the seal groove.

Further, because the projecting amount of the engagement piece member toward the seal groove can be increased owing to the urging projections, even if the lens peripheral surface has an undesirable warp, the contact to the peripheral surface can be assured and, accordingly, the reliability of the engagement of the outer lens can be also improved.

DESCRIPTION OF THE PREFERRED EMBODIMENTS

The preferred embodiments of the present invention will now be described with reference to accompanying drawings.

Figure 1:
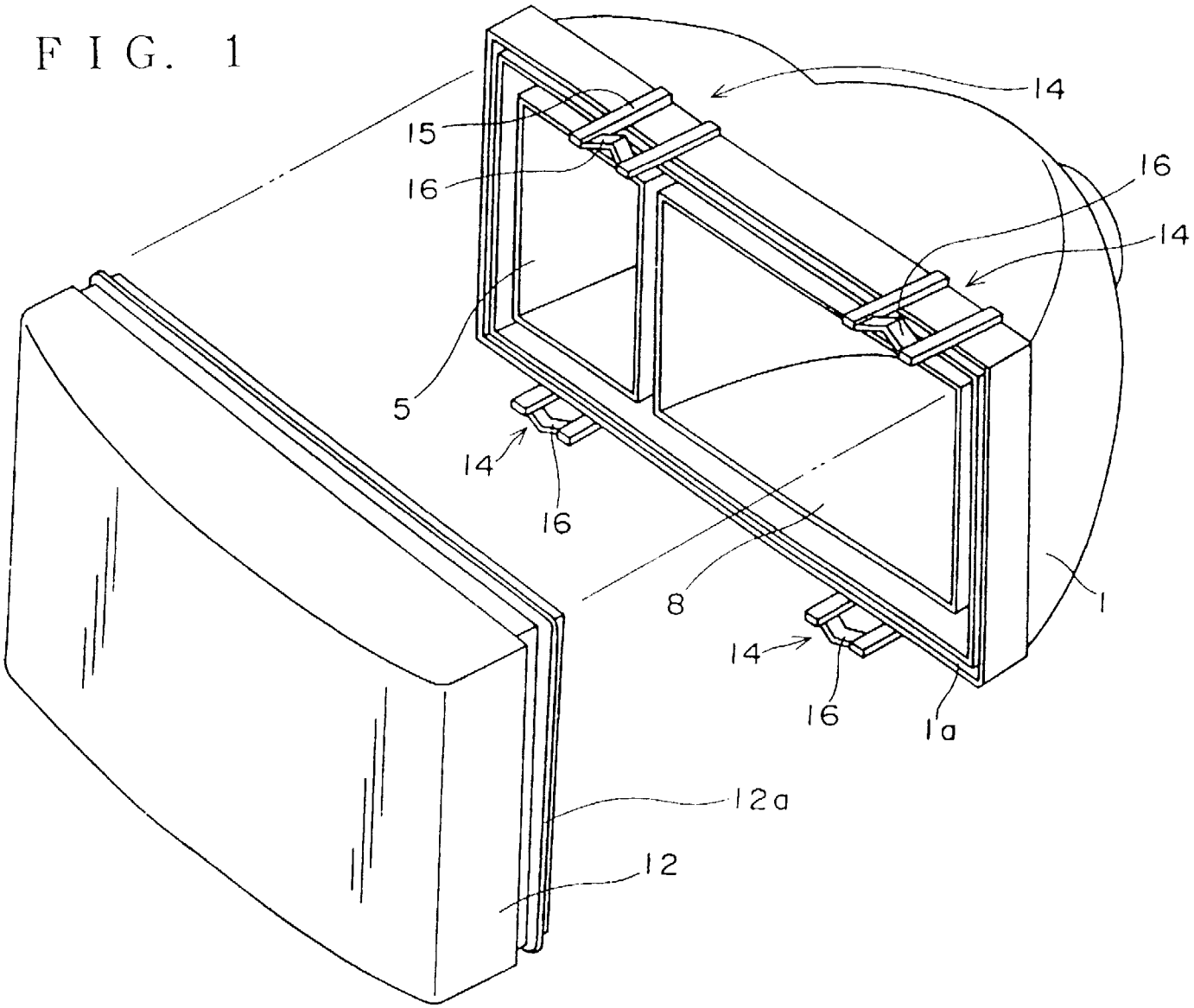
FIG. 1 is a partly exploded perspective view showing a lamp according to a first embodiment of the present invention.
Figure 2:
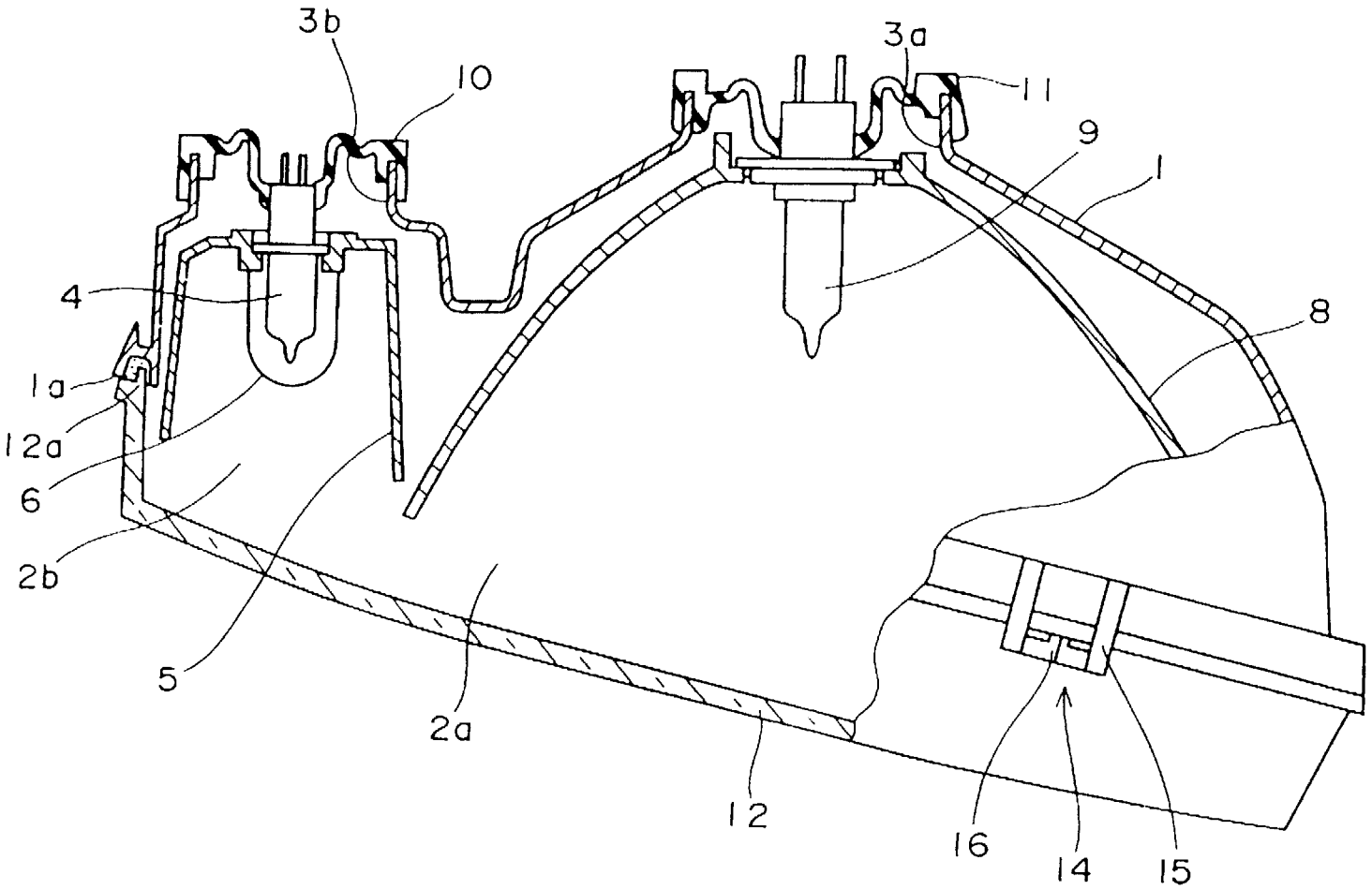
FIG. 2 is a sectional view after assembly of the lamp shown in FIG. 1.

FIGS. 1 and 2 concern a first embodiment of the present invention which is applied to a headlamp for an automobile. More specifically, FIG. 1 is a partly exploded perspective view and FIG. 2 is a sectional view after assembly.

A vessel like lamp body 1 is formed by injection molding process to have two lamp chambers 2*a*, 2*b* each of which is provided at a back surface therein with a lamp bulb insertion holes 3*a*, 3*b*, respectively. The small lamp chamber 2*b* serves as a fog lamp, and a reflector 5 supporting a lamp bulb 4 is installed therein. The lamp bulb 4 is covered with an amber cap 6 to emit amber colored light beams. On the other hand, the large lamp chamber 2*a* serves as a headlamp, and a reflector 8 is installed therein. A lamp bulb 9 is inserted through and supported by a peak part of the reflector 8.

Caps 10, 11 formed of rubber material cover gaps defined between metal piece parts of the lamp bulbs 4, 9 and the bulb insertion holes 3*b*, 3*a*, respectively, so that only electrode disposed on the metal piece parts of the lamp bulbs 4, 9 are exposed. Though it is not described here, the lamp described above is supported by an aiming mechanism thereby to adjust optical axis of the lamp with respect to the automobile body.

Figure 4A:
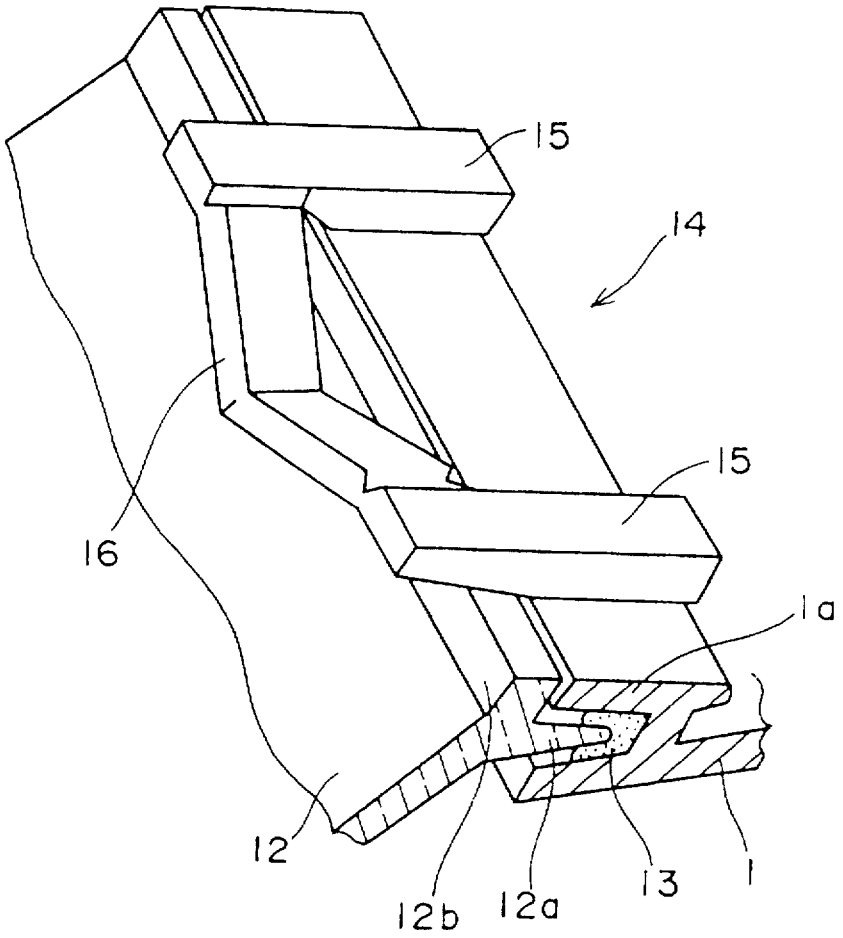
FIGS. 4A and 4B is an enlarged perspective and a sectional views of the essential part of the lamp attachment structure according to the first embodiment of the invention.
Figure 4B:
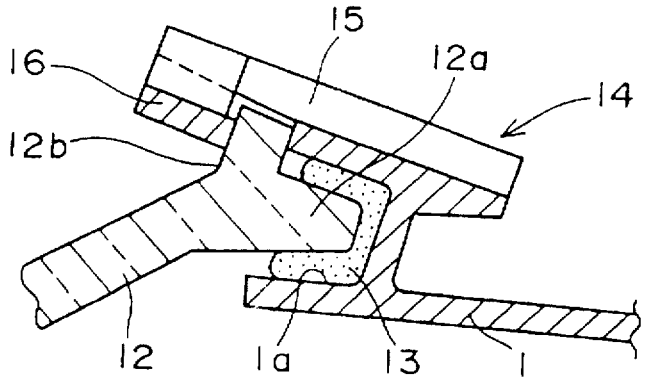

An outer lens 12 is coupled to a front opening of the lamp body 1 for defining the lamp chambers 2*a*, 2*b*. The structure for attaching the outer lens 12 to the lamp body is similar to that of the conventional structure. That is, a seal groove 1*a*, which is a substantially U-shaped in cross section, is formed on the opening part of the lamp body 1 along the periphery thereof, and a seal leg 12*a* projecting from the periphery of the outer lens 12 is fitted in the seal groove 1*a* while a seal material 13 such as adhesive as shown in FIG. 4 is filled in the seal groove 1*a*. Therefore, the seal groove 1*a* and the seal leg 12*a* are secured to each other thereby to assure the coupling of the outer lens 12 to the lamp body 1.

According to the present invention, a plurality of engagement devices 14, which are integrally formed with the front opening part of the lamp body 1, are disposed along the periphery of the seal groove 1*a*. According to the first embodiment, the engagement devices 14 are disposed at two positions on both the upper and lower periphery of the seal groove 1*a*. The engagement devices 14 perform to cramp the peripheral part of the outer lens 12 with the seal groove 1*a* of the front opening part of the lamp body 1.

Figure 3A:
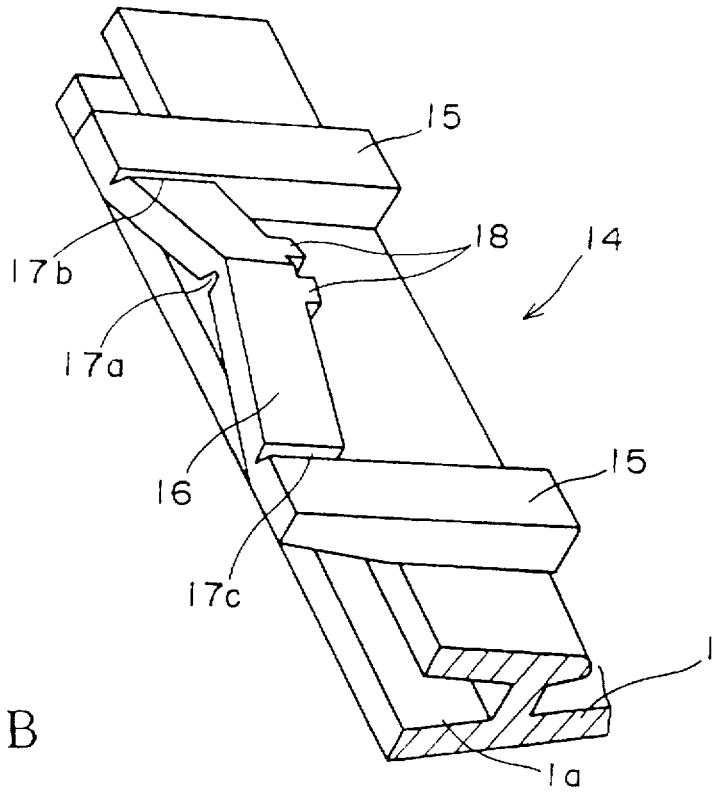
FIGS. 3A, 3B and 3C are a perspective, a plan and a front views, respectively, of an engagement device according to the first embodiment of the invention.
Figure 3B:
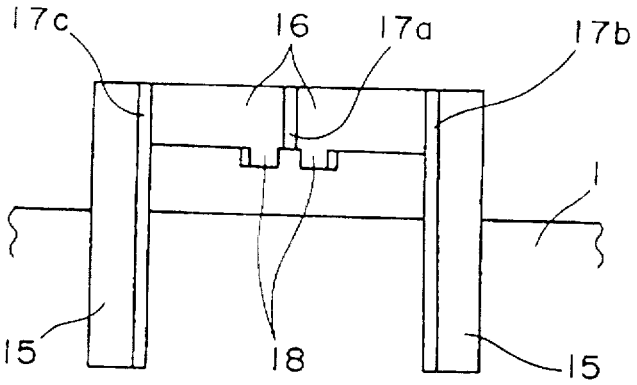
Figure 3C:
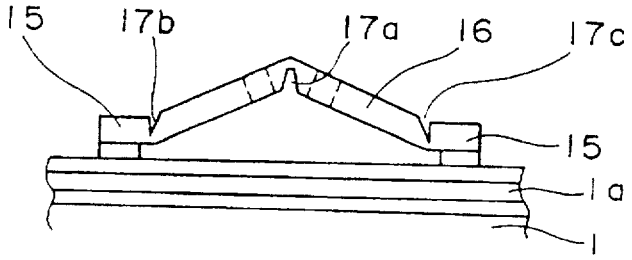

FIGS. 3A, 3B and 3C are a perspective, a plan and a front views, respectively, of the engagement device 14. As shown in the figures, a pair of support members or beams 15 distanced from each other are disposed on an outer wall of the seal groove 1*a* of the lamp body 1 and protrude toward the opening direction of the seal groove 1*a*. The height dimension of the beam 15 is designed to correspond to the dimension of the seal leg 12*a* of the outer lens 12. A plate like engagement piece member 16 extends from the tip end part of each of the beams 15 to bridge thereover. The engagement piece member 16 is formed to bend outwardly of the lamp body 1 at a center part thereof.

The beams 15 and the engagement piece member 16 are integrally formed with the lamp body 1 by the resin molding process. The engagement piece member 16 is provided at the center part and both the connecting parts to the couple of beams 15 thereof with three tapered grooves 17*a*, 17*b* and 17*c* extending along the longitudinal direction of the beam 15 and serving as hinge sections. According to the first embodiment, the center groove 17*a* opens on one surface facing the seal groove 1*a* whereas the both edge grooves 17*b*, 17*c* opens opposite side to the center groove 17*a*. A couple of urging projections 18 protrude from an inner side surface of the engagement piece member 16 at both sides of the center groove 17*a*. The urging projections 18 have a very short height directing to the back surface of the lamp body 1.

With the structure described above, as shown in FIGS. 4A and 4B, during assembly, the seal leg 12*a* of the outer lens 12 is fitted in the seal groove 1*a* formed along the front opening of the lamp body 1, and then the seal material 13 is filled in the seal groove 1*a*. Afterwards, the center part of the engagement piece member 16, which is bent outwardly of the lamp body 1, is urged toward the seal groove 1*a*.

By the operation, the engagement piece member 16 is deformed inwardly at the grooves 17*b*, 17*c* so that the center part thereof moves to the seal groove 1*a* side. The center groove 17*a* of the engagement piece member 16 allows the deformation to be easily. When the center part of the engagement piece member 16 is moved inwardly, the center part comes to position in front of the peripheral surface 12*b* of the outer lens 12, and the urging projections 18 protruding from the inner side surface of the center part of the engagement piece member 16 comes into abutment against the front surface of the peripheral surface 12*b*. The engagement piece member 16 urges the peripheral surface 12*b* against the seal groove 1*a*through the urging projections 18, so that the seal leg 12*a* of the outer lens 12 is prevented from detaching from the seal groove 1*a*.

Especially, even if there may be a tolerance in flatness of the peripheral surface 12*b* of the outer lens 12, the urging projections 18 absolves it and accurately urges the peripheral surface 12*b*.

Accordingly, according to the first embodiment of the invention, the outer lens 12 can be assuredly prevented from detaching from the lamp body 1 only by pushing down the engagement piece member 16 of the engagement device 14 disposed at four positions along the periphery of the front opening of the lamp body 1 from its original condition to the bent condition. According to the present invention, the conventionally employed plate spring is no more necessary. For this reason, the number of components can be reduced and the difficulty for cramping the plate spring is no more required and, therefore, the assembly steps can be reduced.

Figure 5A:
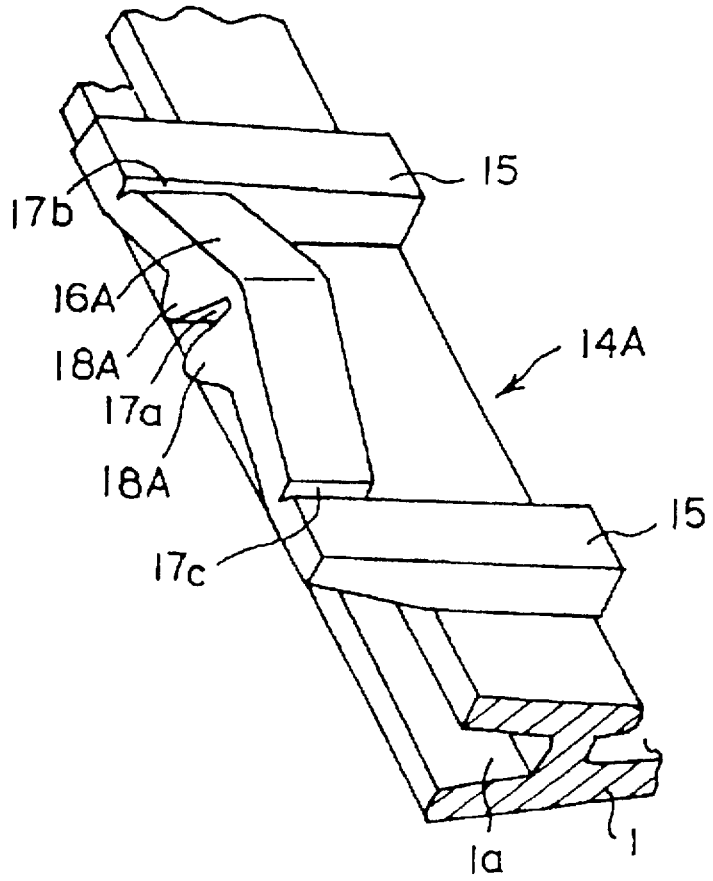
FIGS. 5A and 5B are a perspective and a plan views, respectively, showing an engagement device according to a second embodiment of the present invention.
Figure 5B:
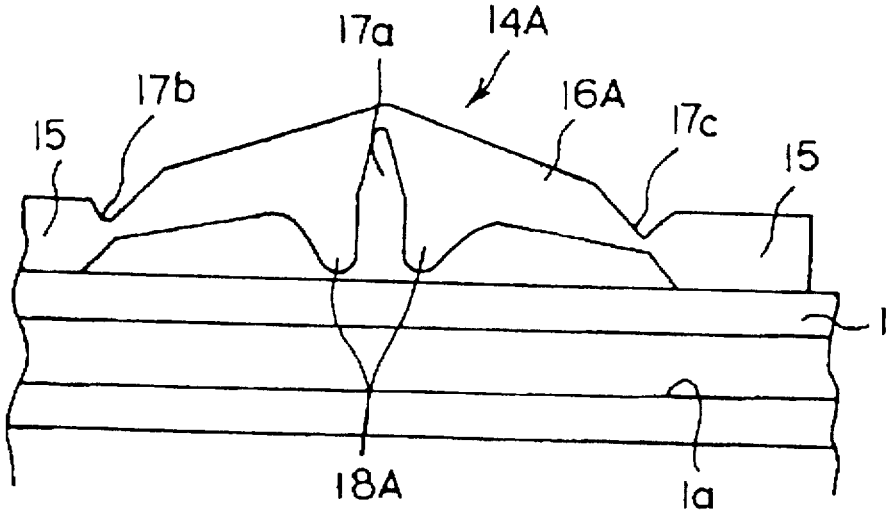

FIGS. 5A and 5B are a perspective and a plan views, respectively, showing an engagement device 14A according to a second embodiment of the present invention, which is a modification of the first embodiment described above.

The engagement device 14A is provided with an engagement piece member 16A provided to connect a pair of beams 15 disposed on the front opening of the lamp body 1. The engagement piece member 16A is integrally formed with the lamp body 1 by resin molding process. The engagement piece member 16A is, similar to the firth embodiment, formed to bend outwardly of the lamp body 1 at a center part thereof. The engagement piece member 16A is provided at the center part and both the connecting parts to the couple of beams 15 thereof with three tapered grooves 17*a*, 17*b* and 17*c* extending along the longitudinal direction of the beam 15 and serving as hinge sections.

According to the first embodiment, the center groove 17*a* opens on one surface facing the seal groove 1*a* whereas the both edge grooves 17*b*, 17*c* opens opposite side to the center groove 17*a*. The engagement piece member 16A is also provided with a couple of urging projections 18A protruding from a surface thereof facing the seal groove 1*a* at both sides of the center groove 17*a*. The urging projection 18A is formed by partly expanding the thickness of the engagement piece member 16A to be substantially triangular.

Figure 6A:
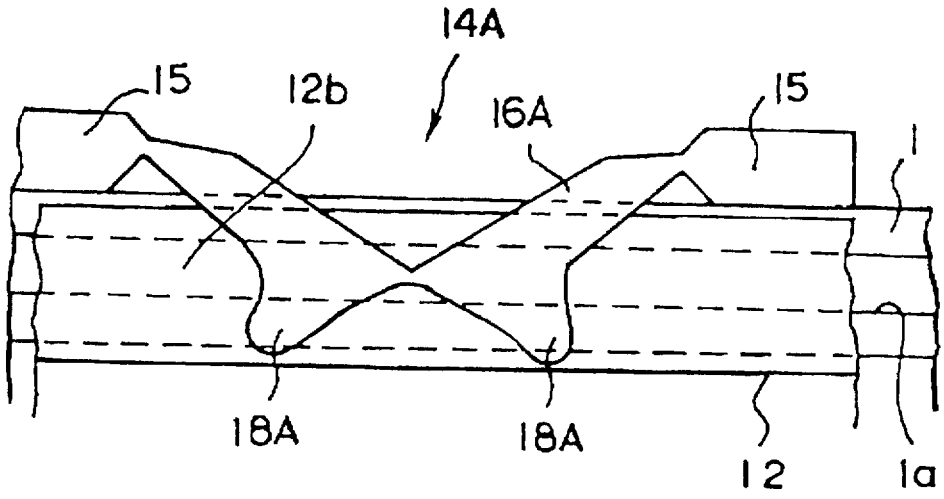
FIGS. 6A and 6B are a plan and sectional views showing the operated conditions of an engagement piece member of the second embodiment of the invention.
Figure 6B:
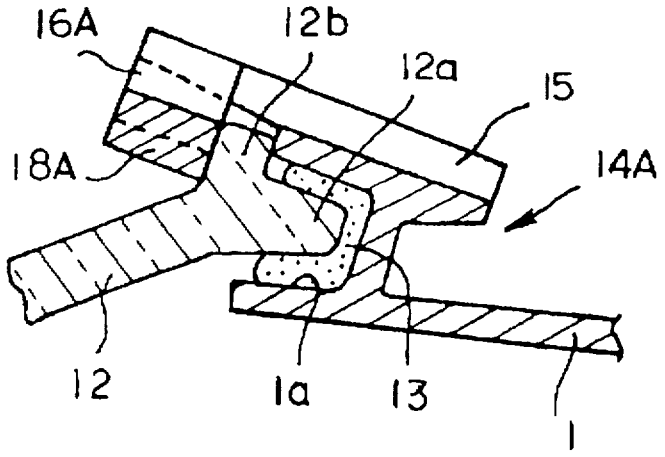

FIGS. 6A and 6B are a plan and sectional views showing the operated conditions of the engagement piece member 16A. With the structure of the engagement device 14A having the engagement piece member 16A described above, as similar to the first embodiment, during assembly the seal leg 12*a* of the outer lens 12 is fitted in the seal groove 1*a* formed along the front opening of the lamp body 1, and then the seal material 13 is filled in the seal groove 1*a*. Afterwards, the center part of the engagement piece member 16A, which is bent outwardly of the lamp body 1, is urged toward the seal groove 1*a*.

By the operation, the engagement piece member 16A is deformed inwardly at the grooves 17*b*, 17*c* so that the center part of which moves to the seal groove 1*a* side. When the center part of the engagement piece member 16A is moved inwardly, the center part comes to position in front of the peripheral surface 12*b* of the outer lens 12, and the thick urging projections 18A disposed on the center part of the engagement piece member 16 comes into abutment against the front surface of the peripheral surface 12*b*. The engagement piece member 16 urges the peripheral surface 12*b* against the seal groove 1*a* through the urging projections 18A, so that the seal leg 12*a* of the outer lens 12 is prevented from detaching from the seal groove 1*a*.

According to the second embodiment, since the urging projections 18A formed by partly expanding the thickness of the engagement piece member 16A contacts to the peripheral surface 12*b* of the outer lens 12, the contact area with respect to the lens peripheral surface 12*b* is enlarged compared to the case where there is no urging projections 18A. Because the contact area of the engagement piece member 16A to the peripheral surface 12*b* is enlarged, the seal leg 12*a* can be effectively prevented from detaching from the seal groove 1*a*. Further, because the projecting amount of the engagement piece member 16A toward the seal groove 1*a* can be increased owing to the urging projections 18A, even if the lens peripheral surface 12*a* has an undesirable warp, the contact to the peripheral surface 12*b* can be assured and, accordingly, the reliability of the engagement of the outer lens can be improved.

Figure 7A:
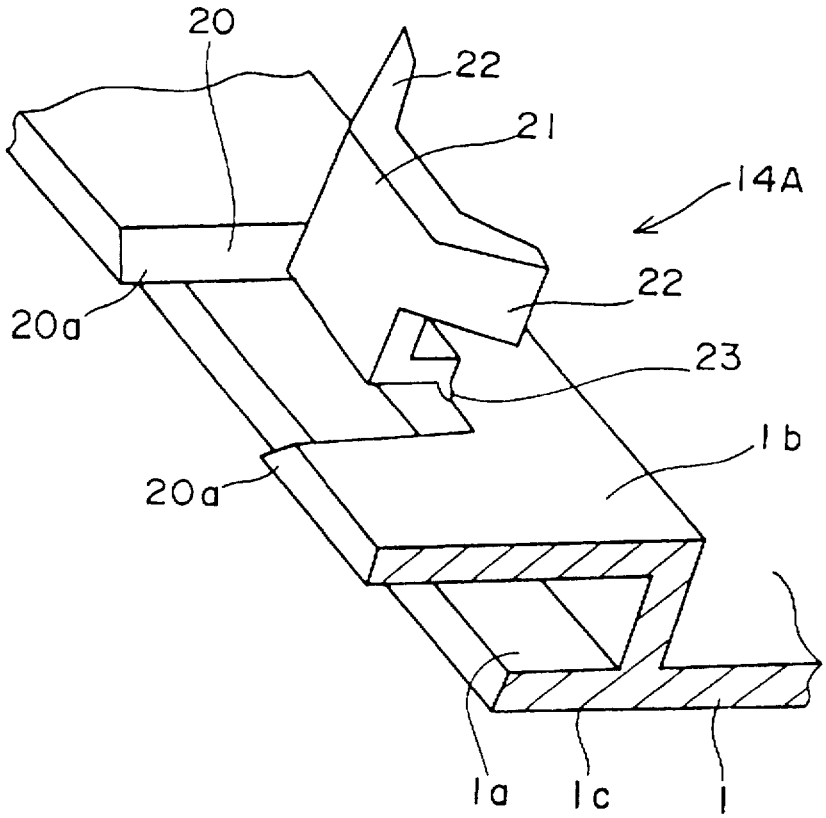
FIGS. 7A and 7B are a perspective and a sectional views, respectively, showing an engagement device according to a third embodiment of the present invention.
Figure 7B:
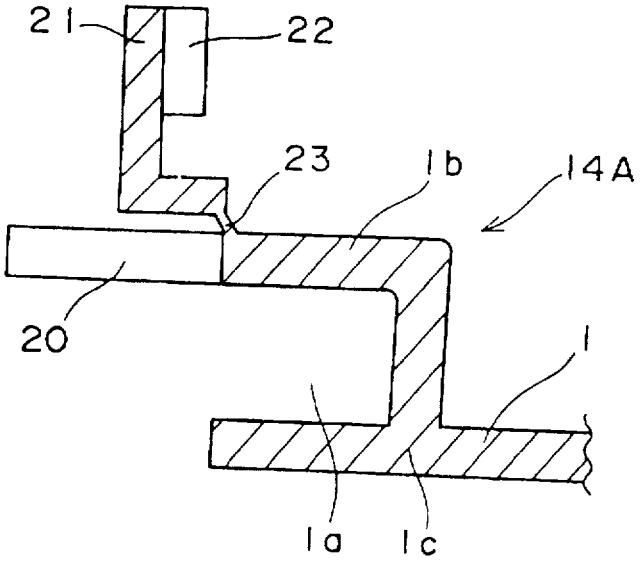

FIGS. 7A and 7B are a perspective and a sectional views, respectively, showing an engagement device 14B according to a third embodiment of the present invention.

According to the third embodiment, an outer wall 1*b* of the seal groove 1*a* is designed to be longer than an inner wall 1*c*, and a rectangular notch 20 is formed on a part of the outer wall 1*b*. Further, an L-shaped engagement piece member 21 is integrally formed with the outer wall 1*b* at a part thereof facing the notch 20. The width of the engagement piece member 21 is shorter than that of the notch 20. The engagement piece member 21 is integrally provided at both sides thereof with a pair of sleeve members 22. A lower edge part of the engagement piece member 21 is integrally connected to the outer wall 1*b* at the bottom of the notch 20 through a thin connecting member 23 performing as a hinge section.

Each of the sleeve members 22 are inclined upwardly while becoming thinner gradually toward a tip end thereof. A distance between the tip end of the sleeve members 22 is designed to be slightly longer than the width of the notch 20. A side edge 20*a* of the notch 20 is tapered up outwardly of the lamp body 1.

Figure 8A:
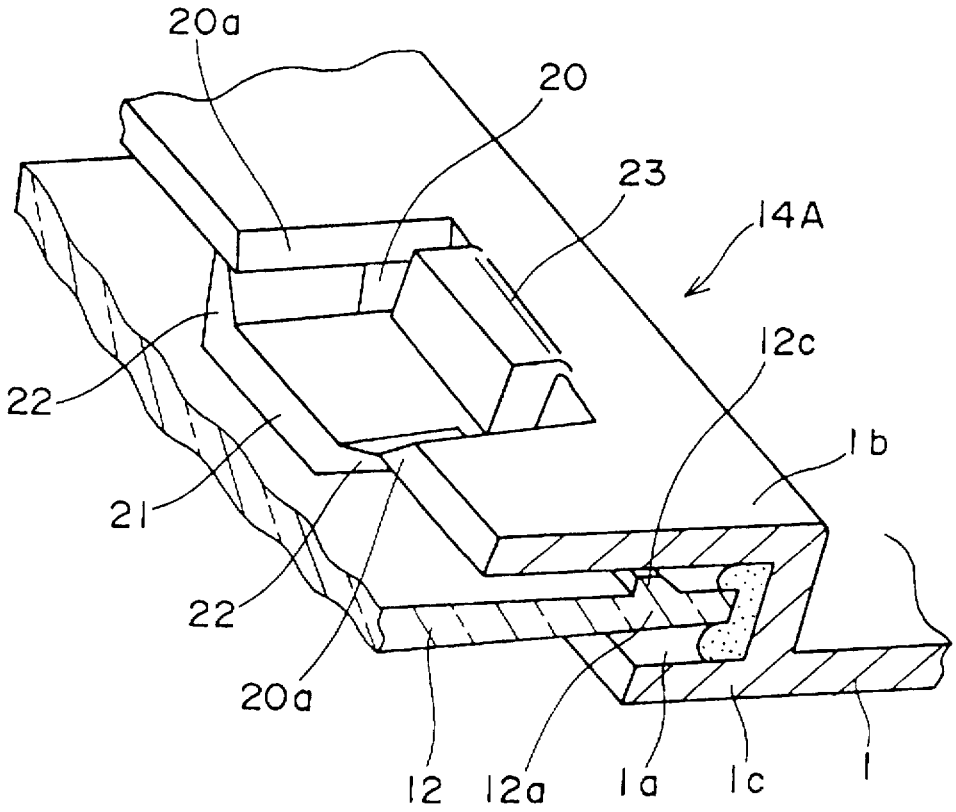
FIGS. 8A and 8B are a perspective and a sectional views, respectively, showing an engagement device after the operation according to a third embodiment of the present invention.
Figure 8B:
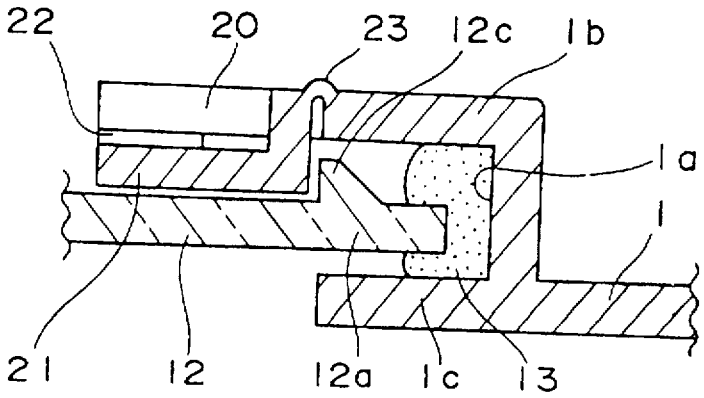
Figure 9A:
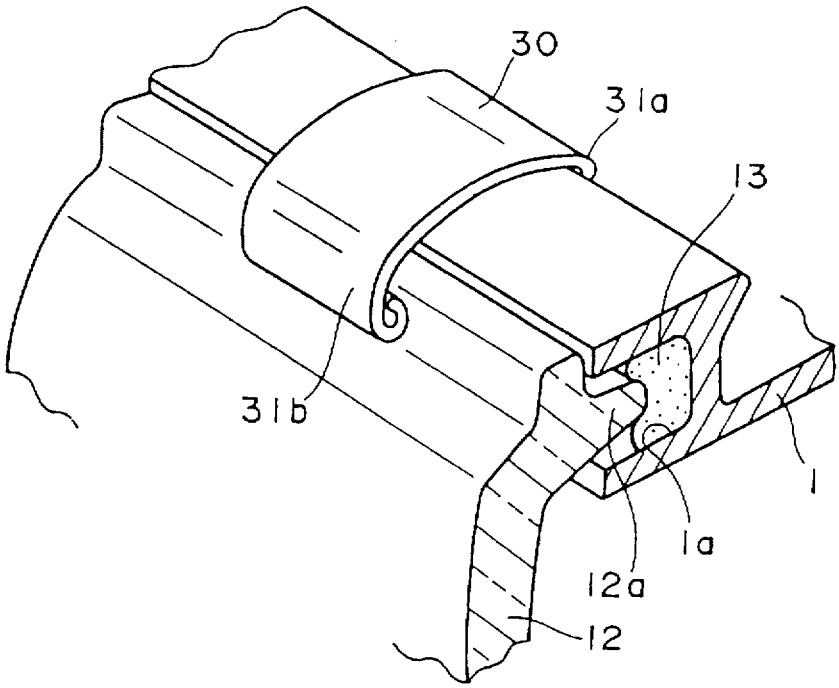
FIG. 9A PRIOR ART
FIGS. 9A and 9B are perspective and sectional views, respectively, showing a conventional vehicular lamp employing a plate spring.
Figure 9B:
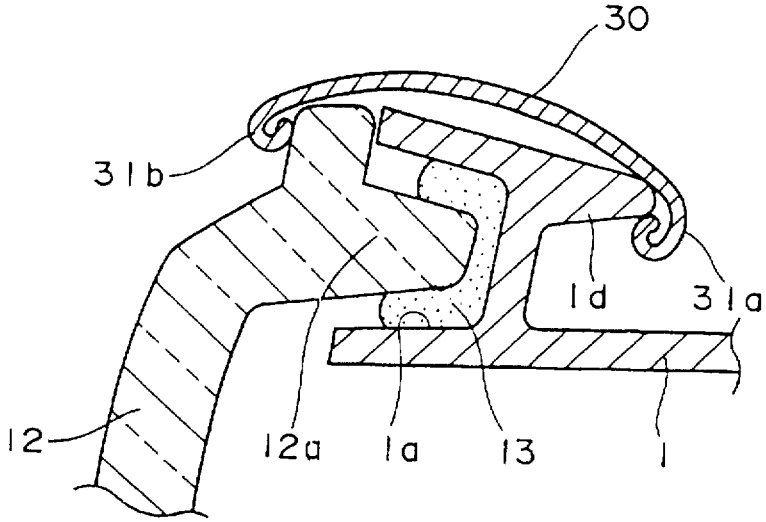
FIG. 9B PRIOR ART

With the engagement device 14B as shown in FIGS. 8A and 8B, after the seal leg 12*a* of the outer lens 12 is fitted in the seal groove 1*a* of the lamp body 1 and the seal material 13 is filled in the seal groove 1*a*, the engagement piece member 21 is depressed down around the connecting member 23 into the notch 20. During the operation, the end part of both the sleeve members 22 are resiliently deformed to move down beyond the side edges 20*a* of the notch 20. After passing the side edges 20*a*, the end part of both the sleeve members 22 return to their original shape owing to their resilient force, so that the sleeve members 22 come into engagement with the side edges 20*a* of the notch 20 and the engagement piece member 21 is kept being depressed down into the notch 20. Under this condition, the bottom part of the engagement piece member 21 which positions on above the seal groove 1*a* comes into contact to a step part 12*c* formed on the seal leg 12*a* of the outer lens 12.

According also to the third embodiment of the invention, the outer lens 12 can be assuredly prevented from detaching from the lamp body 1 only by depressing down the engagement piece member 22 of the engagement device 14B to be engaged with the notch 20. Therefore, the outer lens can be stably attached to the lamp body.

Other than described above, various configurations of the engagement device may be employed. According to the first, second and third embodiments described above, no slide core is required for molding the engagement device when the engagement device is integrally formed with the lamp body by resin molding process. Therefore, the molding process can be readily achieved.

Further, the number of the engagement devices can be freely selected. In addition, though the invention is applied to the automotive headlamp in the foregoing embodiments, the invention is not limited thereto or thereby. The present invention may be applied to every types of lamps which requires a plate spring.

As described above, according to the present invention, a lamp body is integrally formed with an engagement device having an engagement piece member which is bent inwardly of an opening part of the lamp body to be engaged therewith. When the engagement piece member is depressed to be bent inwardly, the engagement piece member urges the peripheral part of the outer lens against the opening periphery of the lamp body so that the peripheral part of the outer lens is securely held between the engagement piece member and the opening periphery of the lamp body.

Owing to the structure of the engagement device of the present invention, the outer lens can be stably attached to the lamp body without necessitating the conventional plate spring which has been provided separately from the lamp body or the outer lens. Hence, the process for cramping the plate spring can be eliminated. Accordingly, the low manufacturing cost and the easy assembly of the lamp can be realized.

It should be understood that the form of the invention herein shown and described is to be taken as a preferred example of the invention and that various changes in the shape, size and arrangement of parts may be resorted to without departing from the spirit of the invention or the scope of the subjoined claims.

What is claimed is:

1. A lens attachment device for attaching a lens to a lamp body, comprising:

a support member integrally formed with the lamp body;

an engagement piece member integrally formed with said support member, said engagement piece member being deformable to be bent with respect to said support member between a first position where the lens is allowed to couple to the lamp body and a second position where the lens is prevented from detaching from the lamp body; and a hinge member extending along a longitudinal direction of said support member and disposed at a connecting part of said support member to said engagement piece, and wherein said support member comprises a pair of beams spaced apart from each other, and said engagement piece member extends between tip end parts of each of said beams.

2. The lens attachment device according to claim 1, wherein said engagement piece member comprises a hinge part at a center thereof, and a center part of said engagement piece member engages a peripheral surface of the outer lens when said engagement piece member is in said second position.

3. The lens attachment device according to claim 2, wherein said engagement piece member comprises at least one urging projection protruding from a surface thereof, and said urging projection has a very short height directed toward the lamp body.

4. The lens attachment device according to claim 2, wherein said support member, said engagement piece member and said hinge member are integrally formed with the lamp body by molding process.

5. The lens attachment device according to claim 2, wherein a plurality of the lens attachment device are provided along an opening periphery of the lamp body.

* * * * *